United States Patent [19]

Kamiya

[11] Patent Number: 4,700,646

[45] Date of Patent: Oct. 20, 1987

[54] SEWING MACHINE WITH RETRACTABLE HANDWHEEL

[75] Inventor: Osamu Kamiya, Nagoya, Japan

[73] Assignee: Brother Kogyo Kabushiki Kaisha, Nagoya, Japan

[21] Appl. No.: 910,596

[22] Filed: Sep. 23, 1986

[30] Foreign Application Priority Data

Oct. 28, 1985 [JP] Japan ..... 60-240882

[51] Int. Cl.[4] ..... D05B 69/34

[52] U.S. Cl. ..... 112/279; 112/283; 74/554

[58] Field of Search ..... 112/279, 283, 220, 258, 112/259; 74/552, 554

[56] References Cited

U.S. PATENT DOCUMENTS

| | | | |
|---|---|---|---|
| 3,269,211 | 8/1966 | McGarry | 74/554 X |
| 3,817,360 | 6/1974 | Bianchi | 112/283 X |
| 4,091,755 | 5/1978 | Ishikawa et al. | 112/279 |
| 4,183,473 | 1/1980 | Neuweiler et al. | 112/279 X |
| 4,434,880 | 3/1984 | Kornatowski | 112/279 X |
| 4,503,793 | 3/1985 | Odermann | 112/279 X |
| 4,522,140 | 6/1985 | Koide | 112/279 |

*Primary Examiner*—Werner H. Schroeder
*Assistant Examiner*—Andrew M. Falk
*Attorney, Agent, or Firm*—Schwartz & Weinrieb

[57] ABSTRACT

A sewing machine has a retractable handwheel which is always biased toward the outside of the frame by a resilient member. When pushed into the frame against the biasing action of the resilient member, the handwheel is locked in a retracted position in the frame by an actuating member. The handwheel is released in conjunction with operation for opening a cover covering the spool chamber of the sewing machine to allow the handwheel to be projected outwardly of the frame, so that the manual rotation of the handwheel may be effected.

20 Claims, 8 Drawing Figures

SEWING MACHINE WITH RETRACTABLE HANDWHEEL

FIELD OF THE INVENTION

The present invention relates to a sewing machine with a retractable handwheel, and more specifically to a sewing machine provided with a handwheel connected to the main shaft thereof and adapted to be projected outwardly of the frame for manual rotation during performance of preparatory operation for sewing and to be retracted into the frame except during the aforenoted preparatory operation.

BACKGROUND OF THE INVENTION

Generally, domestic sewing machines and industrial sewing machines are provided with a handwheel on the right-hand side of the frame. The handwheel is connected to the main shaft for rotation together with the main shaft. Prior to starting the sewing operation, the handwheel is rotated slightly in the forward or reverse direction by the operator so as to vertically move a needle bar which is interlocked through means of a crank mechanism with the main shaft. For example, the needle bar is lowered by rotating the handwheel so as to facilitate positioning fabric work for aligning a sewing starting position on the fabric with the needle location, or alternatively the needle bar is raised by rotating the handwheel so as to facilitate replacement of the presser foot and the needle.

As mentioned above, the handwheel is necessary for the manual operation of the sewing instrumentalities only in preparing for performance of the sewing operation and once the sewing operation is started, the handwheel is never used. Even though the handwheel is infrequently used, it always occupies a position projecting outwardly from the right-hand side of the frame. This tends to make the sewing machine obsolete in appearance and affords little scope for a novel design to be introduced into the sewing machine. Moreover, when carrying the sewing machine, the handwheel projecting outwardly from the frame may often strike against a solid object thereby causing damage to the handwheel. Thus, in general, the handwheel is merely a nuisance when the sewing machine is not being operated.

Furthermore, since the handwheel always projects outwardly from the frame during the sewing operation, the rotary motion of the handwheel is dangerous to the operator. Still further, the disposition of the handwheel outside of the frame requires a machine cover to have additional capacity for accommodating the handwheel and therefore, the machine necessitates a large space for installation.

OBJECTS OF THE INVENTION

Accordingly, it is the primary object of the present invention to provide a sewing machine which includes a handwheel which is retractable into the frame thereof.

It is another object of the present invention to provide a sewing machine which may afford significant changes to its external design, which may be compact in construction, and which may enhance safety during operation.

It is a further object of the present invention to provide a sewing machine which includes a handwheel which may be retracted into the frame thereof and which may be selectively projected from the frame thereof through means of a manual operation.

SUMMARY OF THE INVENTION

In a sewing machine equipped with a handwheel according to the present invention, the handwheel is mounted on the main shaft so as to be rotatable therewith and axially movable thereon, and a resilient member, interposed between the handwheel and the main shaft, biases the handwheel toward the outside of the frame. A spool chamber, for accommodating a spool and formed within the backside of the frame, is covered with a cover, and an actuating member is provided which serves to lock the handwheel in a retracted position within the frame when the cover is closed and also serves to release the handwheel from the retracted position when the cover is opened.

In the sewing machine according to the present invention, when pushed axially inward, the handwheel moves a predetermined distance relative to the main shaft and is engaged by the actuating member so as to be locked at the retracted position within the frame. On the other hand, when the cover is opened, the handwheel is released from the actuating member and is moved by means of the biasing action of the resilient member so as to project outwardly from the frame.

Thus, according to the present invention, the handwheel is projected outwardly from the frame so as to allow the manual rotation thereof at least during the preparation for a sewing operation and the handwheel can be retracted into the frame except during the preparatory operation, and hence, a novel design in appearance can be introduced into the sewing machine. Furthermore, while the sewing machine is being carried, the handwheel can never strike against a solid object, and therefore there is no possibility of damage occurring to the handwheel. Moreover, a machine cover for covering the sewing instrumentalities of the sewing machine need not have an extra space for accommodating the handwheel, and the sewing machine can therefore be made compact in construction. Still further, the retractability feature of the handwheel into the frame during performance of the sewing operation eliminates the exposure of rotary members outside of the frame, and hence safety during the operation of the sewing machine is enhanced.

BRIEF DESCRIPTION OF THE DRAWINGS

Various other objects, features, and attendant advantages of the present invention will become more fully appreciated, when considered in connection with the accompanying drawings, in which like reference characters designate like or corresponding parts throughout the different views, and wherein.

DESCRIPTION OF THE PREFERRED EMBODIMENT

The present invention will be described hereinafter with reference to a preferred embodiment thereof in conjunction with the accompanying drawings.

Spool Chamber and the Cover

Figure 8:
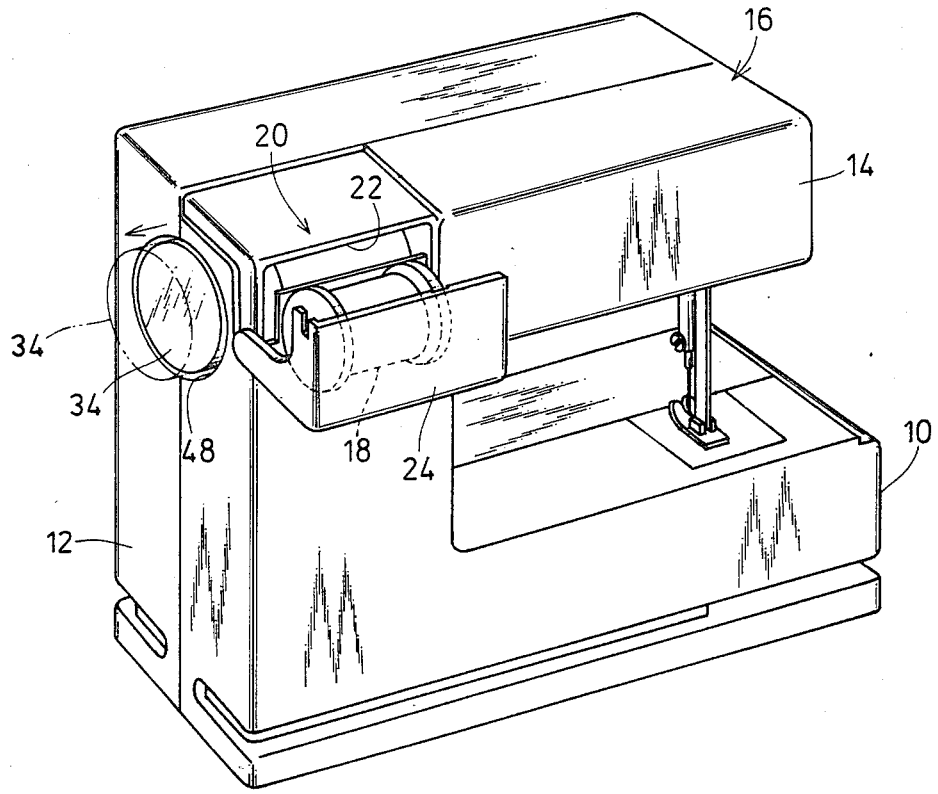
FIG. 8 is a perspective view of a sewing machine according to the present invention as viewed from the backside thereof, showing a spool chamber and a cover for covering the spool chamber.

The sewing machine of the present invention employs a cover, for covering a spool chamber as will be described hereinafter and as illustrated in FIG. 8, as a motive means for projecting a handwheel, stored within the frame thereof, outwardly of the same. First, an outline of the arrangement of the motive means will be described. As illustrated in FIG. 8, the sewing machine according to a preferred embodiment of the present invention has a frame 16 comprising a base 10 having a work supporting surface, a standard 12 extending upright from the base 10, and an arm 14 extending horizontally above the base 10. A spool chamber 20 is formed in the backside of the frame 16 at the junction of the standard 12 and the arm 14, and serves to accommodate a needle thread supply or spool 18 disposed in a horizontal position.

Figure 4:
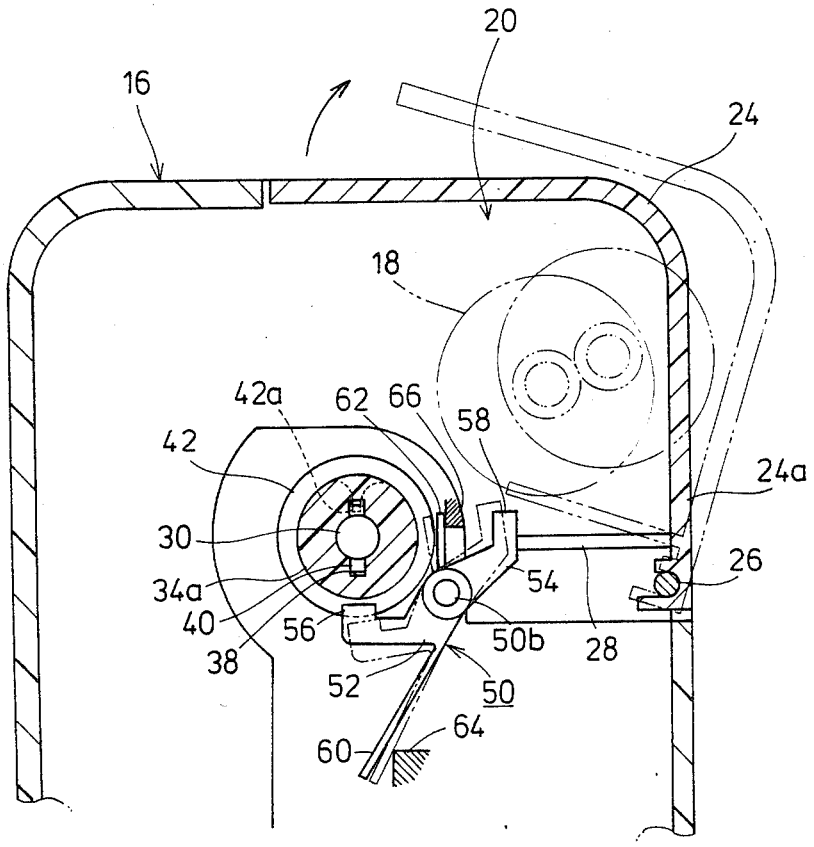
FIG. 4 is a sectional view taken on line IV—IV in FIG. 3.

The spool chamber 20 has a rear opening 22 which can be covered by means of a cover 24 having a generally L-shaped cross-sectional configuration as best illustrated in FIG. 4. The cover 24 is pivotally supported at the lower end of the vertical wall 24*a* thereof on pivotal shafts 26 projecting from the frame 16. During the preparatory operation for the sewing machine and during the sewing operation, the cover 24 is opened and shifted into a horizontal position as illustrated in FIG. 8 and the needle thread is fed from the spool 18 disposed upon the inner surface of the vertical wall 24*a*. A catch 28 is provided and secured to the lower portion of the inner surface of the vertical wall 24*a* so as to extend horizontally into the interior of the frame 16. The basic arrangement of the spool chamber is fully disclosed in a Japanese Utility Model Application filed by the applicant of the present invention, entitled "Spool Accommodating Device for Sewing Machines", Ser. No. 59-158891.

Spline Mechanism

Figure 1:
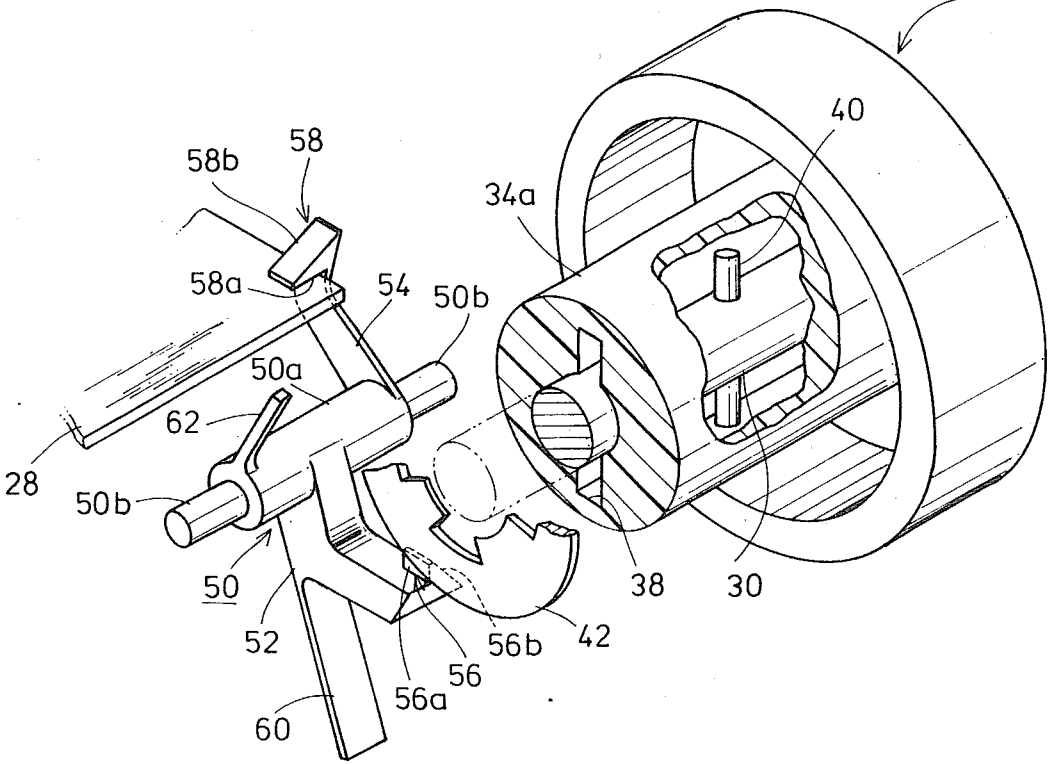
FIG. 1 is a schematic perspective view showing the mode of engagement of a first hook of an actuator with a disk member, and the mode of engagement of a second hook of the actuator with a catch.
Figure 2:
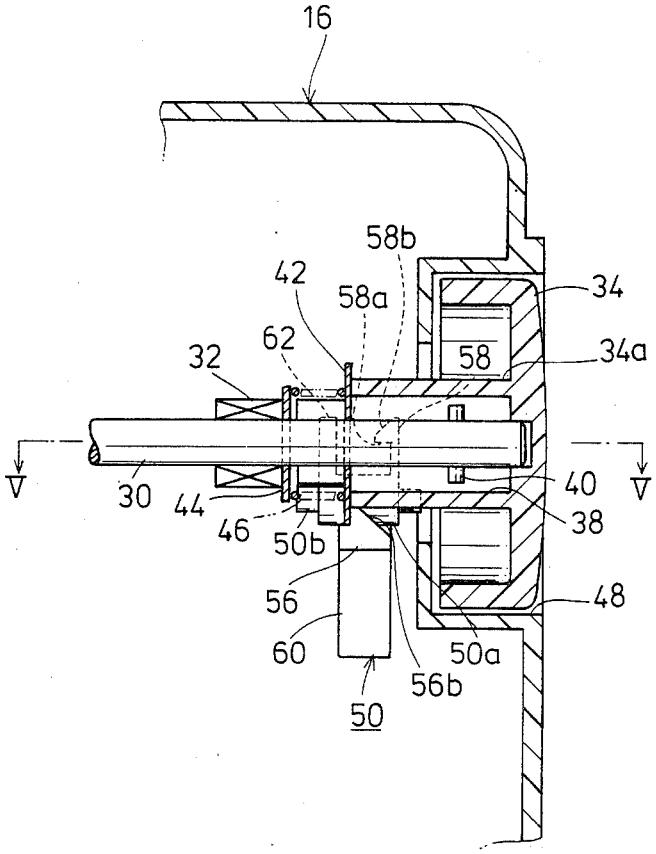
FIG. 2 is a longitudinal sectional view of the essential portion of a preferred embodiment of the present invention, in which the first hook is in engagement with the disk member so as to retain the handwheel within the frame of a sewing machine.
Figure 3:
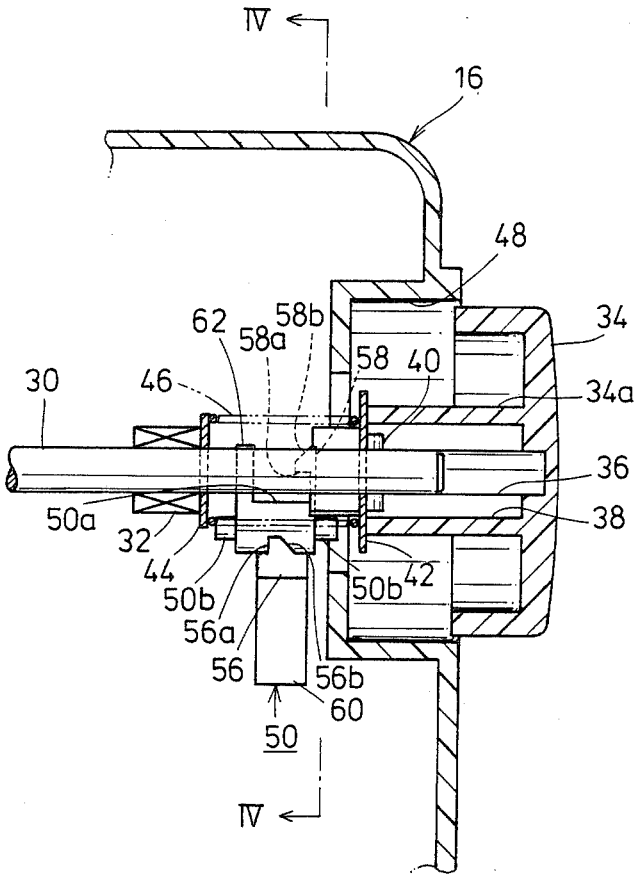
FIG. 3 is a vertical sectional view of the essential portion of the preferred embodiment of the present invention, in which the first hook is disengaged from the disk member, so that the handwheel is projected outside the frame of the sewing machine.
Figure 6:
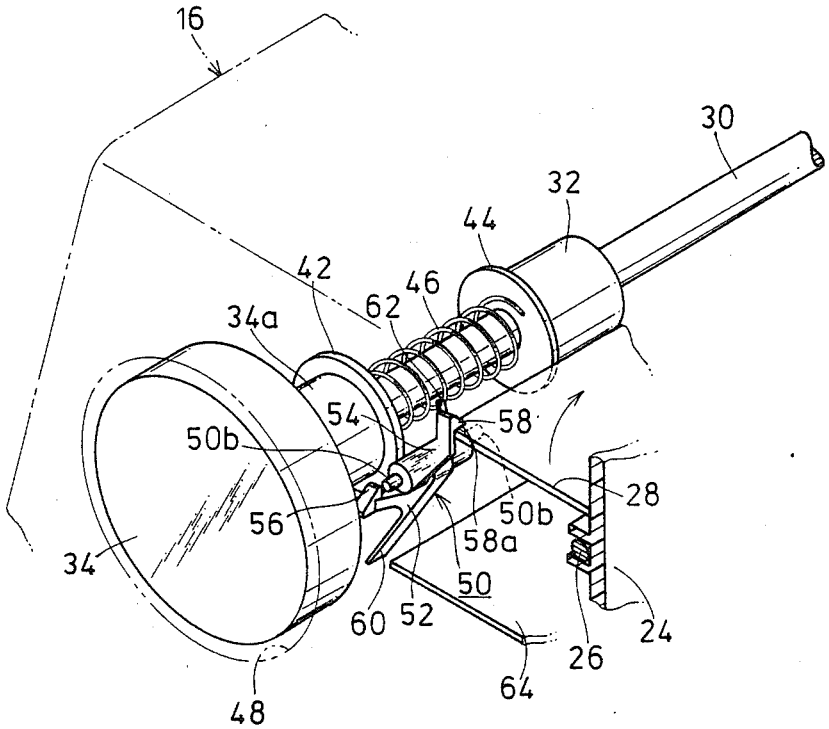
FIG. 6 is a perspective view corresponding to FIG. 2.
Figure 7:
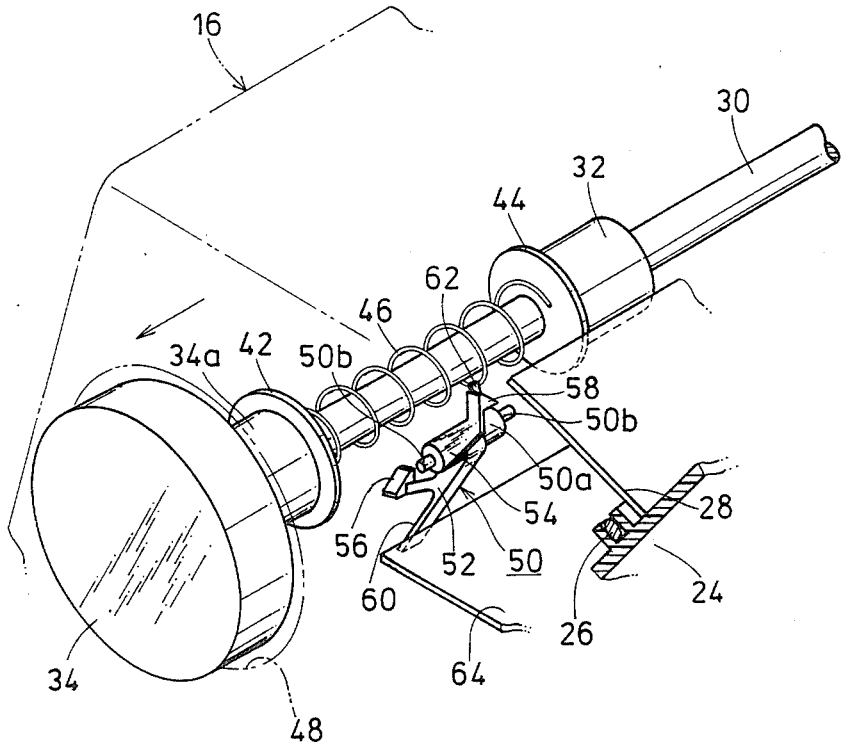
FIG. 7 is a perspective view corresponding to FIG. 3.

As best illustrated in FIGS. 1 to 3, a main shaft 30 is disposed horizontally within the frame 16 and is journaled within the frame 16 through means of a bearing 32. The main shaft 30 is driven for rotation by means of a driving source (not shown). A handwheel 34 is splined to one end of the main shaft 30 so as to be rotatable with and axially slidable along the main shaft 30. Specifically, the main shaft 30 is slidably received within a blind central bore 36 formed within a boss 34*a* of the handwheel 34, and it is noted that the end face of handwheel 34 is closed as best seen in FIGS. 6–8. As illustrated in FIG. 1, a pair of diametrically opposed guide grooves 38 are formed in the boss 34*a* so as to communicate with the central bore 36, and a pin 40 is provided upon the main shaft 30 so as to project perpendicularly, with respect to the axis of the main shaft 30, into the guide grooves 38, whereby the handwheel 34 is axially slidable on and rotatable with the main shaft 30.

As illustrated in FIG. 2, the boss 34*a* has a reduced section so as to form a shoulder. A disk member 42 having a diameter greater than that of the boss 34*a* is secured upon the reduced section of the boss 34*a* so as to rest firmly against the shoulder of the boss 34*a* and, in particular, is fixedly connected to the handwheel 34 by forcibly fitting a tongue 42*a* thereof within the guide groove 38 of the reduced section as shown in FIG. 4. The disk member 42 cooperates with the pin 40 so as to restrict the axial movement of the main shaft 30 whereby it will not become disconnected from the handwheel 34.

A spring seat 44 is mounted on the main shaft 30 so as to rest on the side surface of the bearing 32. A resilient member 46, namely, a cylindrical compression coil spring, is interposed between the spring seat 44 and the disk member 42 secured to the handwheel 34 so as to resiliently bias the handwheel 34 rightward, as viewed in FIG. 3, so that the handwheel 34 is projected outwardly from a cylindrical recess 48 formed within the right-hand side surface of the frame 16. The cylindrical recess 48 is so shaped and sized so as to entirely receive the handwheel 34 therein as shown in FIG. 2 when the handwheel 34 is pushed in the axial direction of the main shaft 30 toward the left as viewed in FIGS. 2 and 3.

Actuating Member

An actuating member 50 is mounted within the frame 16 in a generally confronting relationship with respect to the handwheel 34. The task of this actuating member 50 is to retain the handwheel 34 at a retracted position within the frame 16 and to release the handwheel 34 when the cover 24 is opened so that the handwheel 34 is projected outwardly from the frame 16 under the biasing action of the resilient member 46. The actuating member 50 is an integral member formed in a shape as shown in FIG. 1 by injection molding an elastic synthetic resin such as polypropylene and is disposed between the main shaft 30 and the catch 28 which is secured to the cover 24 within the frame 16. Basically, the actuating member 50 comprises a cylindrical body 50*a* having stub shafts 50*b* formed upon the opposite ends thereof, a first arm 52 extending radially from the medial portion of the body 50*a*, and a second arm 54 extending radially from one end of the body 50*a*.

The actuating member 50 is pivotable within a predetermined angular range about the stub shafts 50*b* which are pivotally supported upon appropriate members (not shown) provided within the frame 16. The first arm 52 and the second arm 54 have a first hook 56 and a second hook 58, respectively, formed upon the respective free ends thereof. The first arm 52 has a first restricting arm 60 for restricting the pivotal movement of the actuating member 50 in one direction. Also, a second restricting arm 62 is provided upon body 50*a* so as to project radially from the other end of the body 50*a* for restricting the pivotal movement of the actuating member 50 in the other direction.

Shape of the First hook

As best illustrated in FIGS. 1 and 3, the first hook 56 has a vertical catching surface 56*a* formed on one side thereof and an inclined surface 56*b* formed on the other side thereof. When the actuating member 50 is pivoted in a predetermined direction, the catching surface 56*a* engages the disk member 42 so as to retain the handwheel 34 at the retracted position within the frame 16 and, when the actuating member 50 is pivoted in the reverse direction, the catching surface 56*a* is disengaged from the disk member 42.

Figure 5:
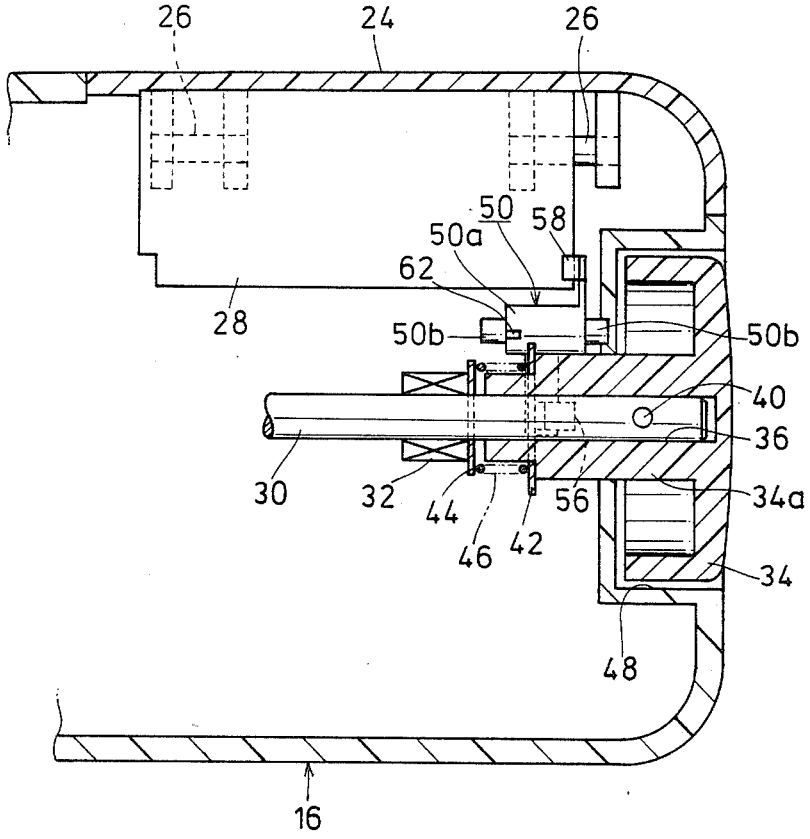
FIG. 5 is a sectional plan view taken on line V—V in FIG. 2.

As illustrated in FIGS. 3 and 5, the catching surface 56*a* of the first hook 56 is so formed as to be located in the linear path of the disk member 42 which is fixed to the handwheel 34. As illustrated in FIG. 3, when the handwheel 34 is projected outwardly from the frame 16 under the biasing action of the resilient member 46, the disk member 42 which is fixed to the handwheel 34 is located at a distance remote from the inclined surface 56*b* of the first hook 56.

The actuating member 50 is pivotable upon the stub shafts 50*b* only within a predetermined angular range and further pivotal movement of the same beyond the predetermined angular range is restricted. Specifically, as may be seen from FIG. 4, stoppers 64 and 66 are provided within the frame 16. The counterclockwise pivotal movement of the actuating member 50 is restricted upon engagement of the first restricting arm 60 with the stopper 64, while the clockwise pivotal movement of the member 50 is restricted upon engagement of the second restricting arm 62 with the stopper 66.

Shape of the Second Hook

As illustrated in FIG. 1, the second hook 58 of the actuating member 50 has a catching surface 58*a* which extends horizontally and faces downward by when the actuating member 50 is supported at a position shown in FIG. 1, and an inclined surface 58*b* extending at a predetermined angle with respect to the catching surface 58*a*. The position of the catching surface 58*a* is such that the catching surface 58*a* is engageable with and disengageable from the catch 28 which is secured to the cover 24 and extending into the interior of the frame 16. As illustrated in FIG. 2 and as will be described below, when the cover 24 is closed, with the catching surface 56*a* of the first hook 56 retained upon the disk member 42 and the handwheel 34 stored within the frame 16, the catch 28 engages the inclined surface 58*b* so as to bend the second arm 54 slightly outwardly, and then the catching surface 58*a* is restored to its original position by means of the resilience of the second arm 54 so as to engage and retain the catch 28. When the cover 24 is opened, the actuating member 50 is pivoted in a manner as will be described below, so that the catching surface 58*a* is released from the catch 28 and the first hook 56 is likewise disengaged from the disk member 42.

Manner of Operation of the Embodiment

Suppose that the first hook 56 of the actuating member 50 is disengaged from the disk member 42 as illustrated in FIGS. 3 and 7. Then, the disk member 42 and the handwheel 34 are moved axially outwardly a predetermined distance relative to the main shaft under the biasing action of the resilient member 46 so that the handwheel 34 is moved outwardly from the recess 48 which is formed within the frame 16. Accordingly, in this state, the handwheel 34 may be operated manually so as to adjust the height of the needle and thus facilitate the preparation for a sewing operation, such as the replacement of the needle and the presser foot.

When the handwheel 34 is required to be stored within the frame 16 after the completion of the preparation for the sewing operation or after the use of the sewing machine has been terminated, the handwheel 34 is pushed inwardly in the axial direction of the main shaft 30. Thus, the handwheel 34 is moved a predetermined distance along the main shaft 30, as illustrated in FIG. 2, against the biasing action of the resilient member 46. When the handwheel 34 is thus moved, since the first hook 56 of the actuating member 50 is located in the path of the disk member 42, the disk member 42 engages the inclined surface 56*b* of the first hook 56 so as to exert a force upon the first hook 56. Consequently, the actuating member 50 is slightly pivoted a predetermined angle in the counterclockwise direction as viewed in FIG. 4 so as to allow the disk member 42 to pass over the inclined surface 56*b*. It is to be noted that when the actuating member 50 is pivoted a predetermined angle in the counterclockwise direction, the first restricting arm 60 is brought into contact with the stopper 64 provided upon the frame 16 so as to restrict the pivotal movement of the actuating member 50. Accordingly, upon passage of the disk member 42 over the inclined surface 56*b*, the actuating member 50 is pivoted in the clockwise direction as a result of the resilience of the first restricting arm 60, so that the catching surface 56*a* of the first hook 56 engages the disk member 42. Consequently, the disk member 42 is fixedly held by means of the catching surface 56*a* of the first hook 56, and therefore the handwheel 34 is held at a predetermined position within the recess 48 formed within the frame 16 thereby compressing the resilient member 46 as illustrated in FIGS. 2 and 6.

When the cover 24 of the spool chamber 20 is closed with the disk member 42 held by means of the first hook 56 and the handwheel 34 stored within the frame 16, the catch 28 provided upon the cover 24 engages the second hook 58 so as to hold the handwheel 34 at the retracted position within the frame 16. That is, when the cover 24 is closed, the catch 28 engages the inclined surface 58*b* of the second hook 58 so as to bend the second arm 54 formed of a synthetic resin, such as polypropylene, away from the catch 28 so as to allow the catch 28 to pass over the second hook 58. Upon passage of the catch 28 over the second hook 58, the second arm 54 is restored to its original position by means of its own resilience, so that the catching surface 58*a* of the second hook 58 engages the catch 28 (FIG. 6).

When it is necessary to use the handwheel 34 in preparation for a sewing operation, the cover 24 covering the spool chamber 20 is opened, causing the handwheel 34 to be projected outwardly from the frame 16. Specifically, in preparing for a sewing operation, the cover 24 covering the spool chamber 20 needs to be opened so as to draw out the needle thread from the spool 18 and to thread the needle. As the cover 24 is opened, the catch 28 engaging the second hook 58 pivots the actuating member 50 about the stub shafts 50*b* in a counterclockwise direction, as viewed in FIG. 4, so that, the first hook 56 of the actuating member 50 is disengaged from the disk member 42. Thereupon, the disk member 42 is moved axially outwardly under the biasing action of the resilient member 46, thereby causing the handwheel 34 to project outwardly from the recess 48 formed within the frame 16.

Obviously many modifications and variations of the present invention are possible in light of the above teachings. It is therefore to be understood that within the scope of the appended claims, the present invention may be practiced otherwise than as specifically described herein.

What is claimed is:

1. A sewing machine having a frame, a main shaft rotatably mounted upon said frame, stitch forming instrumentalities, including a sewing needle, operatively connected to said main shaft, and a handwheel mounted upon and rotatable with said main shaft, said sewing machine comprising:

said handwheel having a closed outer end surface for enclosing the end of said main shaft upon which said handwheel is mounted;

recess means formed within a sidewall of said frame;

means supporting said handwheel for axial slideable movement upon said main shaft between a first retracted position, at which said handwheel is stored within said recess means of said frame such that said closed outer end surface of said handwheel is substantially flush with said sidewall of said frame, and a second extended position at which only said handwheel projects outwardly from said recess means of said frame and beyond said sidewall of said frame so as to thereby permit manual operation of said handwheel by an operator; and means for releasably holding said handwheel at least at one of said first and second retracted and extended positions.

2. A sewing machine according to claim 1, wherein said means for supporting said handwheel includes resilient means adapted to urge said handwheel toward the extended position.

3. A sewing machine according to claim 1, wherein said holding means includes an actuating member engageable with a disk member secured to said handwheel.

4. A sewing machine according to claim 3, including means operable to release said actuating member from engagement with said disk member.

5. A sewing machine according to claim 4, wherein said operable means is a cover for covering a spool chamber formed on said frame, said cover is operatively connected to said actuating member for releasing the latter from engagement with said disk member when said cover is opened.

6. A sewing machine as set forth in claim 1, wherein said means for supporting said handwheel upon said main shaft comprises:

an axially extending boss portion integrally formed upon said handwheel along with said outer end surface;

a central blind bore defined within said boss portion for housing said main shaft;

spline pins fixedly secured to said main shaft and extending perpendicular thereto; and guide grooves defined within said boss portion and communicating with said central bore for housing said spline pins of said main shaft.

7. A sewing machine as set forth in claim 1, wherein said releasable holding means comprises:

a cylindrical disk fixedly secured upon the axially inner end of said handwheel;

an actuating member pivotably mounted upon said sewing machine frame; and a first arm integrally formed upon said actuating member; and catch means integrally formed upon said first arm of said actuating member for engaging said cylindrical disk.

8. A sewing machine as set forth in claim 7, wherein:

said actuating member comprises a cylinder; and said first arm projects substantially radially from said cylindrical actuating member.

9. A sewing machine as set forth in claim 8, further comprising:

a spool chamber cover pivotably mounted upon said frame;

a second arm integrally formed upon said actuating member; and catch means integrally formed upon said second arm of said actuating member for engaging said spool chamber cover such that when said spool chamber cover is opened, said engagement defined between said spool chamber cover and said second arm catch means will cause disengagement of said first arm catch means and said handwheel disk so as to permit said handwheel to be moved to said second extended position.

10. A sewing machine as set forth in claim 9, wherein:

said second arm catch means comprises a horizontally disposed catch surface, extending substantially perpendicular to said second arm, for engaging said spool chamber cover, and an inclined surface for guiding said spool chamber cover into engagement with said horizontal catch surface upon closure of said spool chamber cover.

11. A sewing machine as set forth in claim 9, wherein:

said spool chamber cover has a substantially L-shaped configuration in cross-section.

12. A sewing machine as set forth in claim 7, wherein:

said catch means comprises an upstanding catch surface, extending substantially perpendicular to said first arm, for engaging said cylindrical disk, and an inclined surface for guiding said cylindrical disk into engagement with said upstanding catch surface.

13. A sewing machine as set forth in claim 7, wherein:

said first arm further includes a resilient arm, integrally formed with said first arm, for restricting the pivotable movement of said actuating member in a first direction.

14. A sewing machine as set forth in claim 13, further comprising:

a second resilient arm, integrally formed upon said actuating member, for restricting the pivotable movement of said actuating member in a second direction opposite said first direction.

15. A sewing machine as set forth in claim 14, further comprising:

stop means fixedly mounted within said frame for engaging said first and second resilient arms for limiting the pivotable movement of said actuating member is said first and second directions.

16. A sewing machine having a frame, a main shaft rotatably mounted upon said frame, stitch forming instrumentalities, including a sewing needle, operatively connected to said main shaft, and a handwheel mounted upon and rotatable with said main shaft, said sewing machine comprising:

said handwheel having an outer end surface;

recess means formed within a sidewall of said frame;

means supporting said handwheel for axial slideable movement upon said main shaft between a first retracted position, at which said handwheel is stored within said recess means of said frame such that said outer end surface of said handwheel is substantially flush with said sidewall of said frame, and a second extended position at which said handwheel projects outwardly from said recess means of said frame and beyond said sidewall of said frame so as to thereby permit manual operation of said handwheel by an operator;

means engageable with said handwheel for holding said handwheel at least at one of said first and second retracted and extended positions;

resilient means for biasing said handwheel toward said second extended position; and manually operated means movably disposed upon said frame for causing release of said holding means from engagement with said handwheel so as to permit said handwheel to be moved to said second extended position under the biasing influence of said resilient means.

17. A sewing machine as set forth in claim 16, wherein:

said manually operated means comprises a spool chamber cover pivotably mounted upon said frame.

18. A sewing machine as set forth in claim 16, wherein:

said resilient means for biasing said handwheel toward said second extended position comprises a coil spring.

19. A sewing machine having a frame, a main shaft rotatably mounted on said frame, stitch forming instrumentalities including a sewing needle and operatively connected to said main shaft, and a handwheel mounted on and rotatable with said main shaft, said sewing machine comprising:

means for supporting said handwheel on said main shaft for axial slidable movement between a retracted position in which said handwheel is stored in said frame and an extended position in which said handwheel is projected outwardly of said frame to thereby permit manual operation by an operator;

recess means formed on said frame for accommodating said handwheel therewithin when said handwheel is in the retracted position;

means engageable with said handwheel for holding the same at least in one of the retracted position and the extended position;

resilient means for urging said handwheel toward the extended position;

cover means for covering a spool chamber formed on said frame; and means operatively connected with said cover means for releasing said holding means from engagement with said handwheel.

20. A sewing machine according to claim 19, wherein said means for supporting said handwheel includes resilient means adapted to urge said handwheel toward said extended position.

* * * * *